US012703547B2

(12) United States Patent
Bram et al.

(10) Patent No.: US 12,703,547 B2
(45) Date of Patent: Aug. 11, 2026

(54) CONTAINER LID

(71) Applicant: Brumis Imports Inc., New York, NY (US)

(72) Inventors: Steven Bram, New York, NY (US); Sean Fogarty, Huntington, NY (US)

(73) Assignee: Brumis Imports Inc., New York, NY (US)

( * ) Notice: Subject to any disclaimer, the term of this patent is extended or adjusted under 35 U.S.C. 154(b) by 153 days.

(21) Appl. No.: 18/593,095

(22) Filed: Mar. 1, 2024

(65) Prior Publication Data

US 2024/0294308 A1 Sep. 5, 2024

Related U.S. Application Data

(60) Provisional application No. 63/449,843, filed on Mar. 3, 2023.

(51) Int. Cl.

| | |
|---|---|
| ***B65D 43/26*** | (2006.01) |
| ***A47G 19/22*** | (2006.01) |
| ***B65D 43/02*** | (2006.01) |
| ***B65D 47/24*** | (2006.01) |

(52) U.S. Cl.

CPC ..... *B65D 43/26* (2013.01); *A47G 19/2272* (2013.01); *B65D 43/0225* (2013.01); *B65D 47/249* (2013.01); *B65D 2543/00046* (2013.01)

(58) Field of Classification Search

CPC ..... B65D 43/26; B65D 43/0225; B65D 2543/00046; B65D 47/249

See application file for complete search history.

(56) References Cited

U.S. PATENT DOCUMENTS

| | | | | |
|---|---|---|---|---|
| 7,156,251 | B2 * | 1/2007 | Smith | B65D 47/26 220/253 |
| 7,546,933 | B2 * | 6/2009 | Pinelli | B65D 51/18 220/714 |
| 8,960,490 | B2 * | 2/2015 | Carlile | B65D 47/249 220/264 |
| 9,873,554 | B2 * | 1/2018 | Choltco-Devlin | B65D 51/18 |
| 10,023,366 | B2 * | 7/2018 | Gilbert | B65D 47/245 |
| 11,358,757 | B2 * | 6/2022 | Bitzaya | B65D 43/0214 |
| 11,390,434 | B2 * | 7/2022 | Lowette | B65D 47/249 |

(Continued)

FOREIGN PATENT DOCUMENTS

| | | | | |
|---|---|---|---|---|
| WO | WO-2025024300 A1 * | 1/2025 | | B65D 47/32 |

*Primary Examiner* — Nathan J Jenness
*Assistant Examiner* — Jennifer Castriotta
(74) *Attorney, Agent, or Firm* — Amster, Rothstein & Ebenstein LLP

(57) ABSTRACT

A lid for use on a container includes a drinking opening with a sealing assembly that selectively opens and closes the drinking opening based on movement of a first actuator. In embodiments, the first actuator may be positioned in a locked position or mode in which the seal remains in the drinking opening to prevent fluid from passing therethrough. The first actuator may be positioned in a second position or mode to move the seal into a first open position to allow a limited amount of water to flow through the opening. The first actuator may be positioned in a third position or mode to move the seal into a second open position to allow a larger amount of water to flow through the opening. The sealing assembly may be removed from the lid for cleaning or repair.

14 Claims, 6 Drawing Sheets

(56) References Cited

U.S. PATENT DOCUMENTS

| | | | | |
|---|---|---|---|---|
| 11,577,892 | B2 * | 2/2023 | Wong | B65D 47/061 |
| 2008/0272134 | A1 * | 11/2008 | Rohe | A47G 19/2272<br>220/714 |
| 2014/0197169 | A1 * | 7/2014 | Carlile | B65D 47/20<br>220/254.1 |
| 2017/0253389 | A1 * | 9/2017 | Fogarty | B65D 47/265 |

* cited by examiner

CONTAINER LID

CROSS-REFERENCE TO RELATED APPLICATIONS

The present application claims benefit of and priority to U.S. Provisional Patent Application Ser. No. 63/449,843 filed Mar. 3, 2023 entitled CONTAINER LID, the entire content of which is hereby incorporated by reference herein.

BACKGROUND

Field of the Disclosure

The present invention relates to a lid for use with a container, such as a coffee mug. The lid includes a sealable drinking opening that is selectively closed by a sealing assembly that may be movable between a closed position and at least two different open positions. The sealing assembly is operated using a first actuator that may be placed in a locked mode in which the sealing assembly is locked in a closed position, a first beverage drinking mode in which the sealing assembly is opened to a first open position and a second drinking mode in which the sealing assembly is opened to a second open position, wherein the second open position allows more fluid to pass than the first position.

Related Art

Conventional containers for hot beverages, and cold beverages, that include lids with a drinking opening that can be selectively unsealed for drinking typically allow for the drinking opening to either be open or closed. That is, conventional lids typically do not allow for locking the drinking opening or providing more than one open position.

It would be beneficial to provide a lid for a container that avoids these and other problems.

SUMMARY

It is an object of the present disclosure to provide a lid for a container that includes a drinking opening selectively closed by a sealing assembly based on activation of a first actuator. In embodiments, the sealing assembly may be provided in a closed position to seal the drinking opening and may be moved into at least two open positions.

A container lid in accordance with an embodiment of the present disclosure includes a base configured for connection to an open end of the container; a drinking opening formed in a top surface of the base and in fluid communication with an interior of the container; a sealing assembly movably mounted to move from a closed position in which the drinking opening is sealed, a first open position in which the drinking opening is partially open and a second open position in which the drinking opening is more open; a first actuator operably connected to the sealing assembly and movable relative to the lid to move the sealing assembly from the closed position, to the second open position and to the third open position; and a button configured to interact with the first actuator to set a position of the sealing assembly.

In embodiments, the sealing assembly includes: a seal housing removably mounted in the base, wherein the seal housing includes; a seal arm movably attached to the seal housing and movable from the closed position, to the first open position and the second open position; a seal element mounted on the seal arm and configured to seal the drinking opening when the seal arm is in the closed position, to be spaced a first distance from the drinking opening when the seal arm is in the first open position and to be spaced a second distance from the drinking opening when the seal arm is in the second open position, wherein the second distance is larger than the first distance; and a biasing element configured to bias the seal element in the closed position.

In embodiments, the seal housing is configured to be removably secure to the base using a clip structure that releasably engages openings in a wall of the seal housing.

In embodiments the first actuator includes: a shaft operably connected to the sealing assembly and movable transverse to a central axis of the lid such that movement of the shaft inward moves the seal element away from the drinking opening; a shaft seal surrounding the shaft and preventing leakage of liquid around the shaft; a paddle operably connected to the shaft and movable with the shaft and laterally; a biasing element configured to bias the shaft outward such that the sealing assembly remains in the closed position; and a button accessible from an exterior of the lid and operably connected to the paddle such that pushing the button inward moves the paddle and shaft inward.

In embodiments, the lid includes a button housing mounted in the base, wherein the button is mounted in the button housing and connected to the paddle and movable laterally with the paddle, wherein movement of the button inward is prevented when the button and paddle are in a first lateral position, is limited when the button and paddle are in in a second lateral position and is less limited when the button and paddle are in in the third lateral position.

In embodiments, the button includes a mode protrusion extending upward therefrom and the button housing includes at least three indentations aligned with the mode protrusion and varying in depth to limit inward movement of the button and the paddle.

In embodiments, a first indentation is shallow to prevent inward movement of the button and paddle when the button and paddle are in the first lateral position such that the sealing assembly remains in the closed position.

In embodiments, a second indentation is deeper than the first indentation to allow inward movement of the button and paddle a first limited distance when the button and paddle are in the second lateral position such that the sealing assembly moves to the first open position.

In embodiments, a third indentation is deeper than the second indentation to allow inward movement of the button and paddle a second limited distance, which is larger than the first limited distance, when the button and paddle are in the third lateral position such that the sealing assembly moves to the second open position.

In embodiments, the first actuator includes an indicator operably connected to the paddle and movable therewith such that a position of the indicator is associated with a mode of operation of the lid.

In embodiments, the top surface of the base includes a window positioned to allow visual inspection of the indicator.

In embodiments, the lid includes a cover configured to hold the button housing in place in the base and including an opening to allow external access to the button.

In embodiments, the cover includes indicia positioned adjacent to the opening and aligned with the button indicating a mode of operation associated with position of the button and the paddle.

In embodiments, the sealing assembly allows a first limited flow of liquid through the drinking opening in the first open position suitable for consumption of hot drinks to minimize risk of burning.

In embodiments, the sealing assembly allows a second limited flow of liquid larger than the first limited flow or liquid through the drinking opening in the second open position suitable for consumption of cool drinks.

BRIEF DESCRIPTION OF THE DRAWINGS

The above and related objects, features and advantages of the present disclosure will be more fully understood by reference to the following, detailed description of the preferred, albeit illustrative, embodiments of the present invention when taken in conjunction with the accompanying figures, wherein.

DETAILED DESCRIPTION OF THE EXEMPLARY EMBODIMENTS

Figure 2:
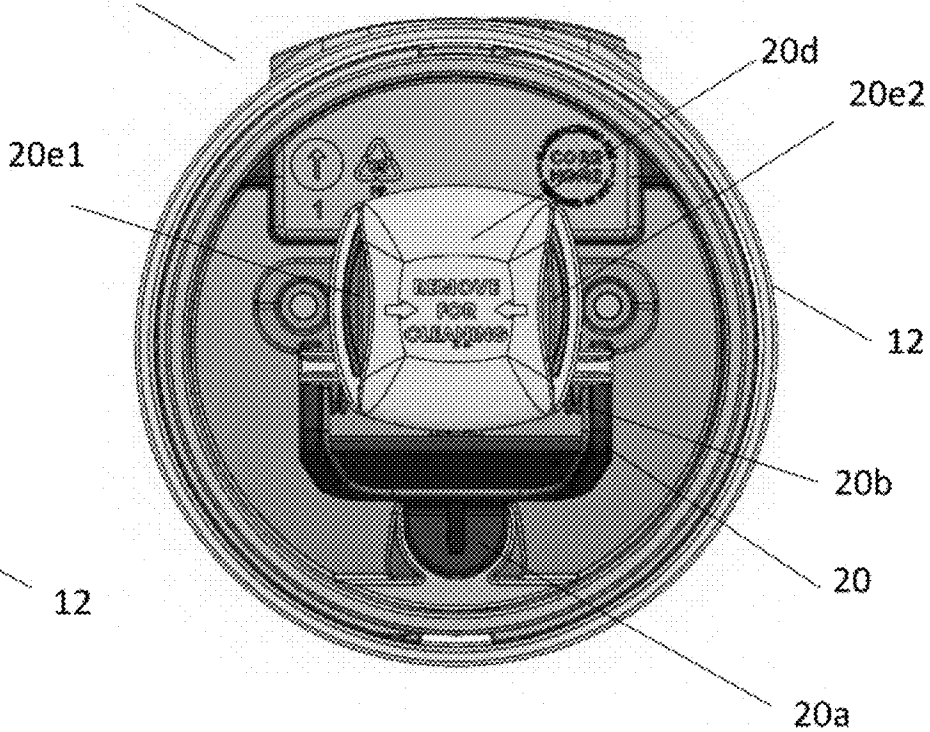
FIG. 2 illustrates a bottom view of the lid of FIG. 1 in accordance with an embodiment of the present disclosure.
Figure 1:
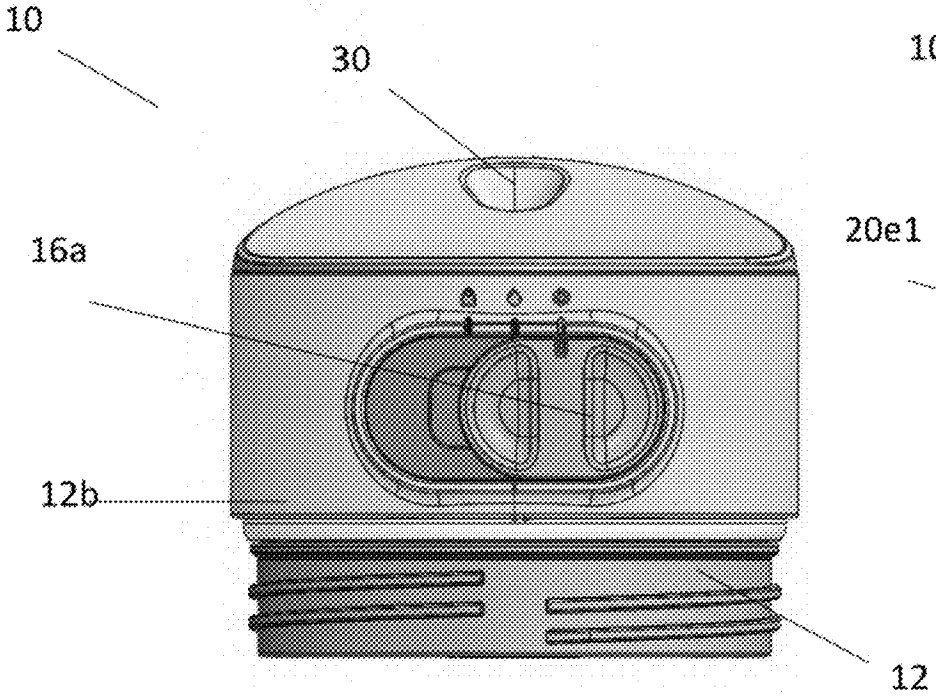
FIG. 1 illustrates a side view of a lid illustrating an actuator in accordance with an embodiment of the present disclosure.

A side view of a lid 10 in accordance with an embodiment of the present disclosure is illustrated in FIG. 1. FIG. 2 illustrates a bottom view of the lid 10 of FIG. 1. In embodiments, the lid 10 may be configured to be mounted on an open end of a container such as a coffee mug or other container. In embodiments, the lid 10 may include a base 12 that may be configured to be received in or around the open end of the container. In embodiments, the base 12 may be secured to the container via one or more threads or using any suitable connection.

Figure 3:
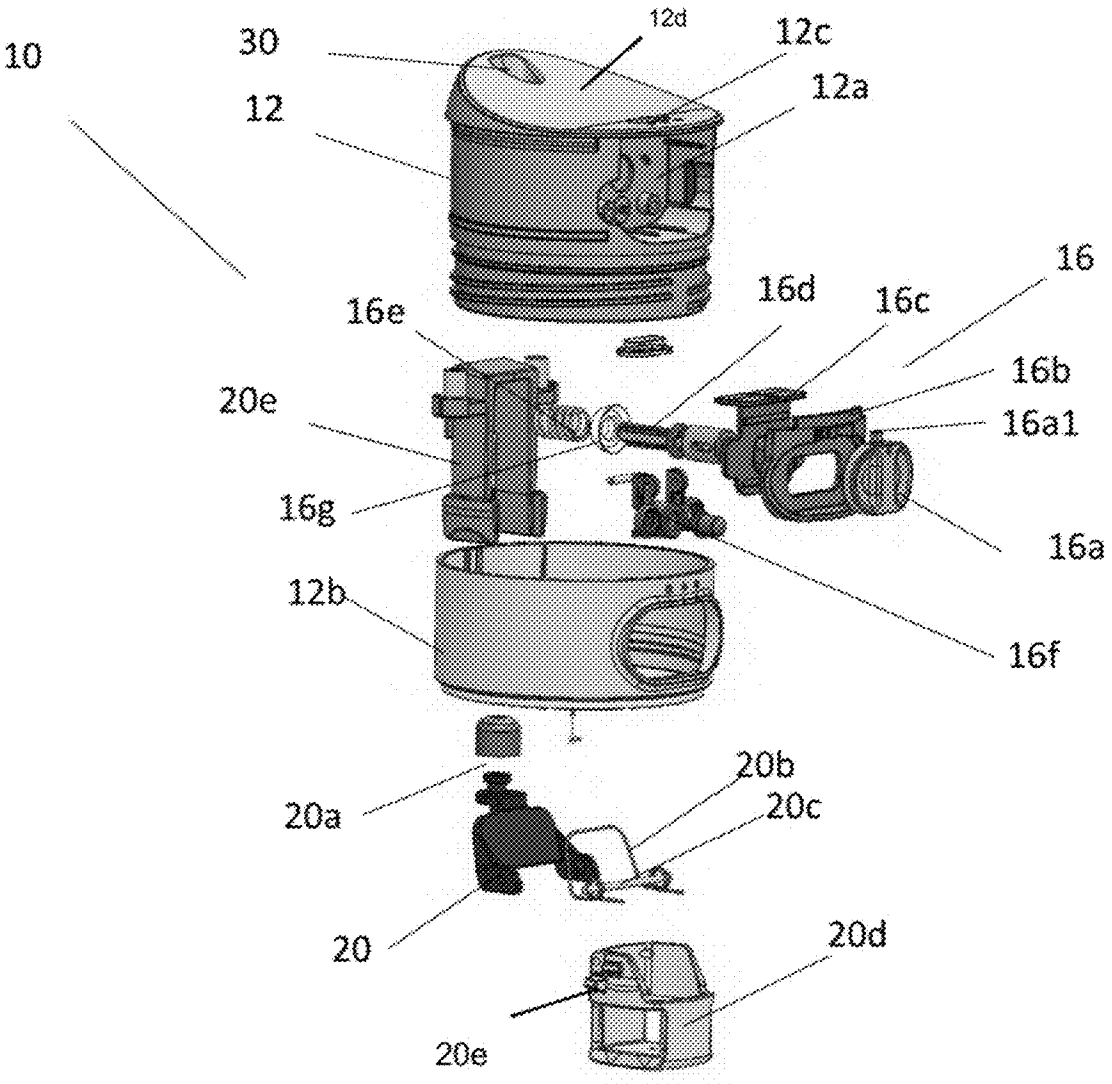
FIG. 3 illustrates an exploded view of the lid of FIGS. 1 and 2 in accordance with an embodiment of the present disclosure.
Figure 4C:
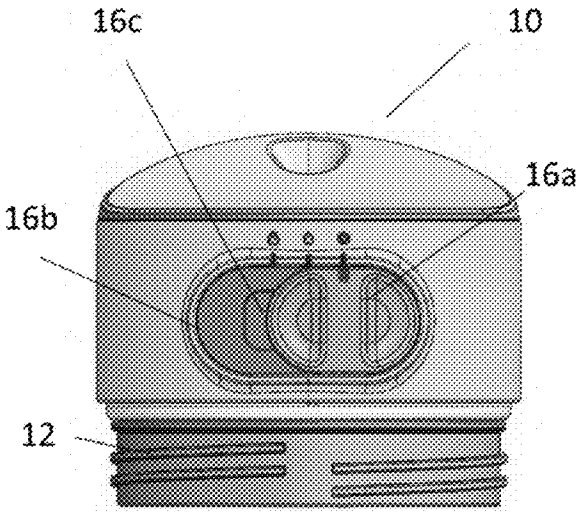
FIG. 4C illustrates the side view of the lid of FIG. 1 with the first actuator in a second open mode in accordance with an embodiment of the present disclosure.
Figure 4B:
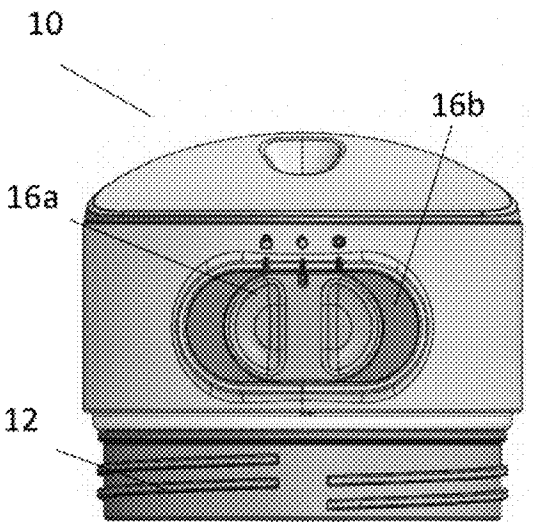
FIG. 4B illustrates the side view of the lid of FIG. 1 with the first actuator in a first open mode in accordance with an embodiment of the present disclosure.
Figure 4A:
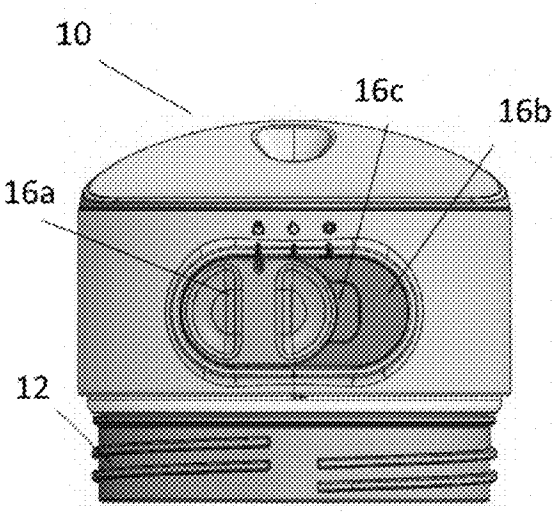
FIG. 4A illustrates the side view of the lid of FIG. 1 with the first actuator in a locked mode in accordance with an embodiment of the present disclosure.
Figure 5:
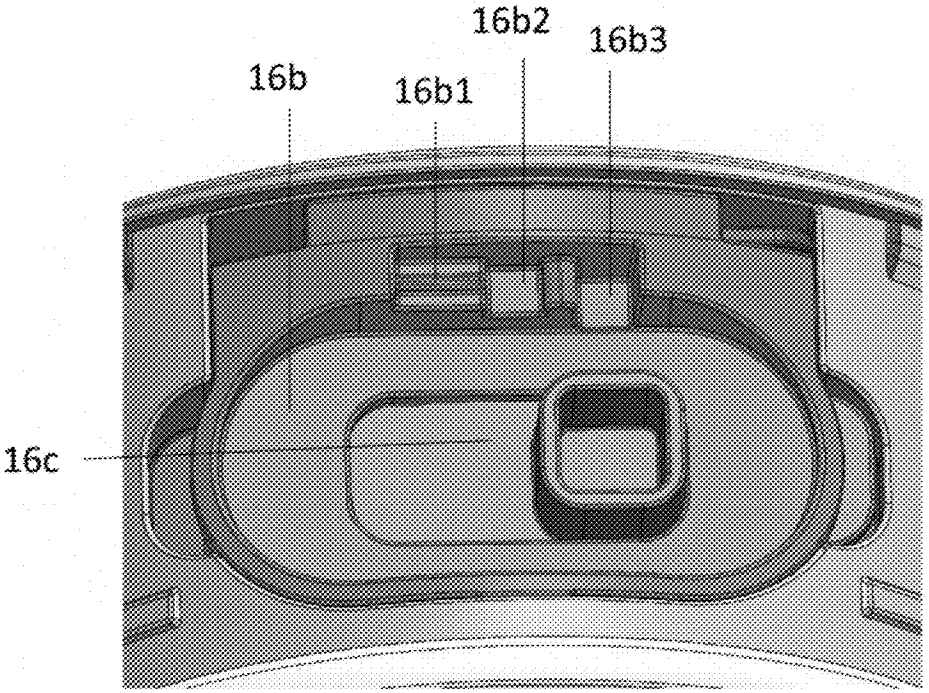
FIG. 5 illustrates a detailed side view of the lid in FIG. 1 with the button removed in accordance with an embodiment of the present disclosure.
Figure 6A:
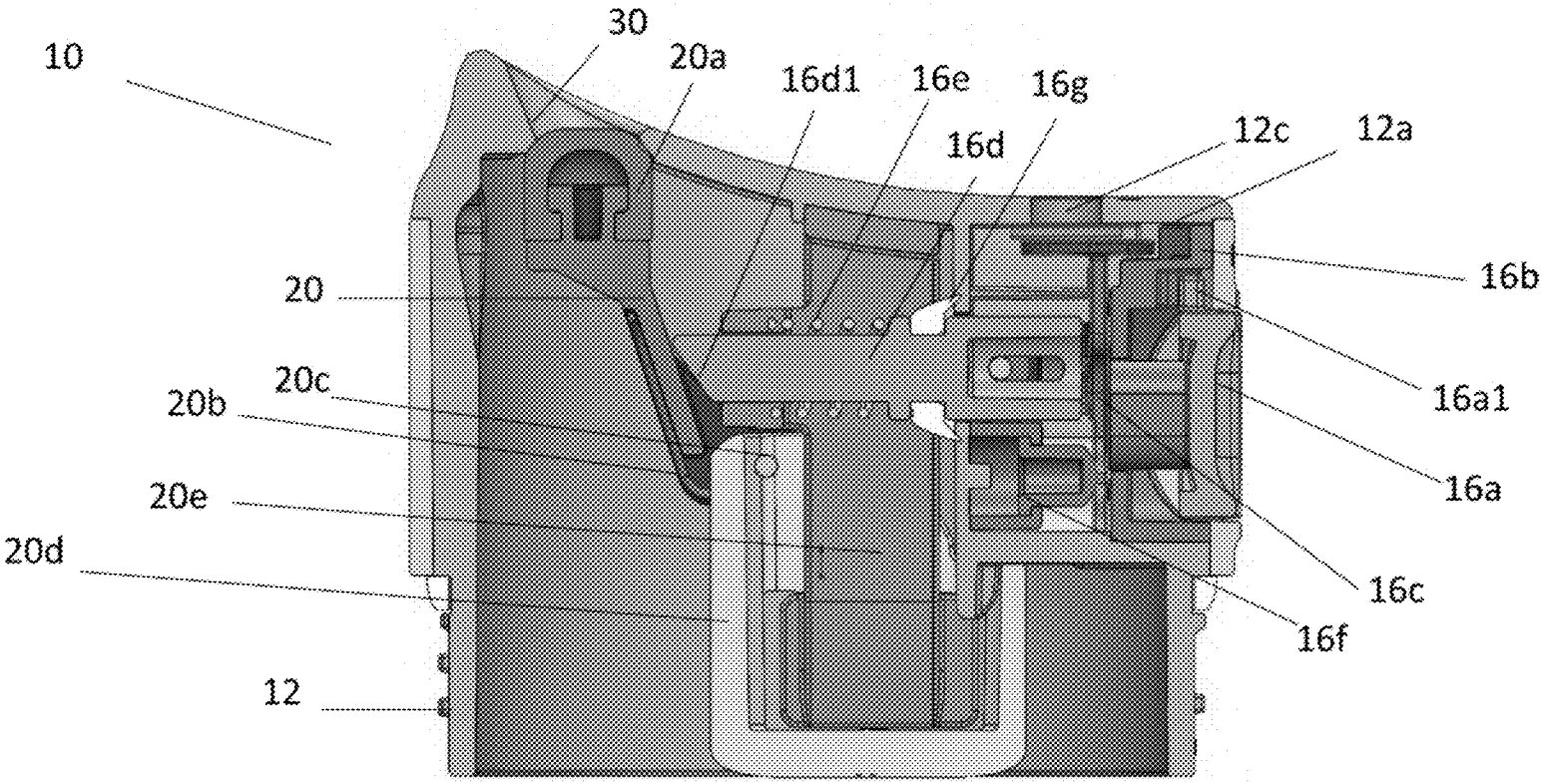
FIG. 6A illustrates a cross-section of a lid showing the first actuator and its interaction with the sealing assembly when the seal is in the closed position in accordance with an embodiment of the present disclosure.
Figure 6B:
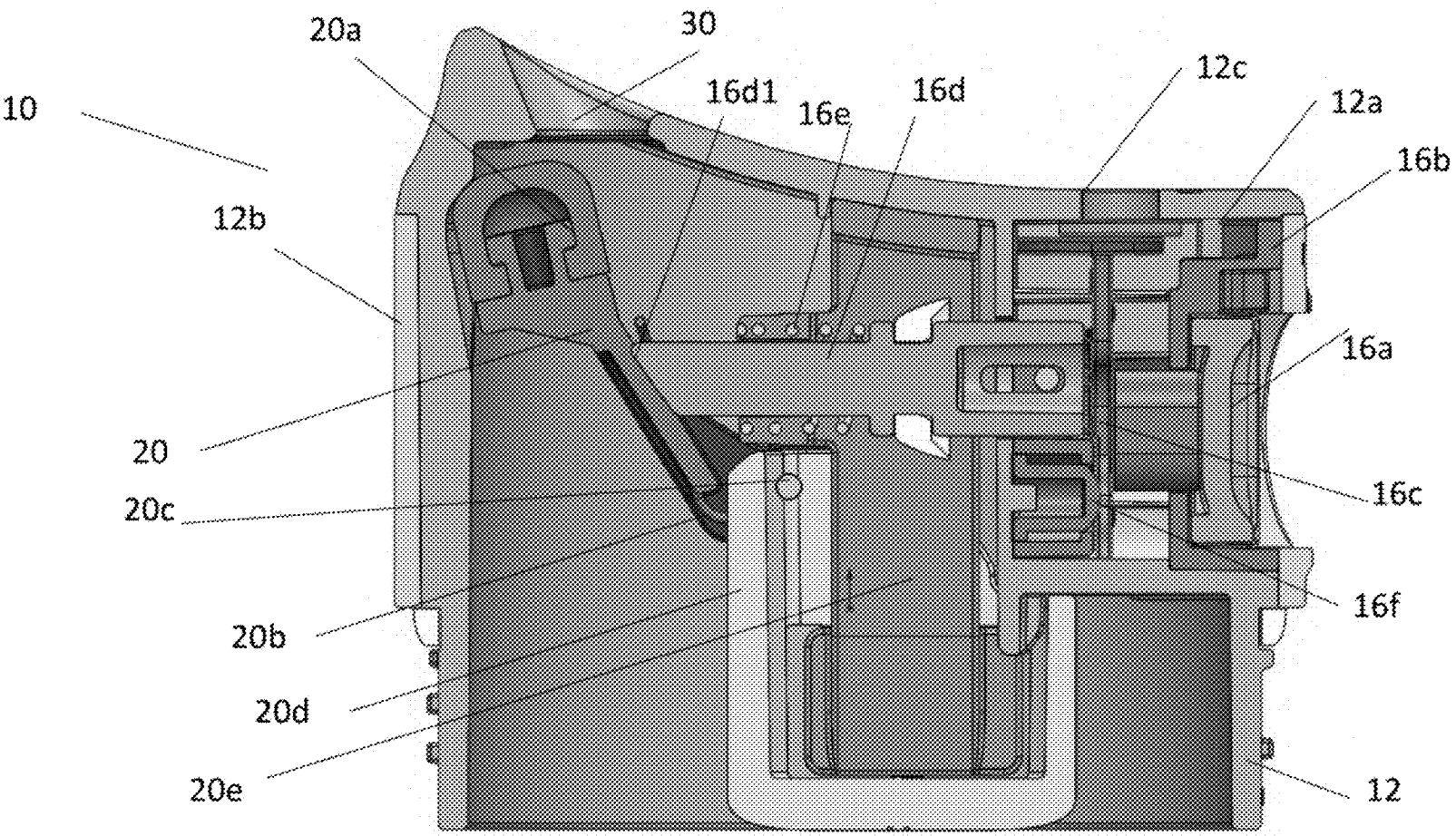
FIG. 6B illustrates a cross-section of a lid showing the first actuator and its interaction with the sealing assembly when the seal is in the open position in accordance with an embodiment of the present disclosure.

In embodiments, the lid 10 may include a drinking opening 30 provided in a top surface 12*d* of the base 12 to allow a user to drink out of the container while the lid is in place. In embodiments, the drinking opening 30 is in fluid communication with the interior of the container and may be selectively sealed by a sealing assembly 20 (see FIG. 3, for example). In embodiments, the sealing assembly 20 may include a seal element 20*a* configured to fit into and seal the drinking opening 30 when the sealing assembly 20 is in a closed position (see FIG. 6A, for example). In embodiments, the sealing assembly 20 may be mounted to pivot about pivot pin 20*c* such that the seal element 20*a* is movable between the closed position in which the seal element is positioned in the opening 30 as shown in FIG. 6A and at least two open positions in which the seal element 20*a* is separated from the opening 30 as illustrated in FIG. 6B, for example, to allow fluid to pass through the drinking opening. In embodiments, the sealing assembly 20 moves the seal 20*a* based on actuation of a first actuator 16. In embodiments, a seal biasing element 20*b* may be provided to bias the seal element 20*a* and seal assembly 20 in the closed position to seal the opening 30.

In embodiments, the first actuator 16 may move inward, transverse to a longitudinal axis of the lid 10 to move the seal element 20*a* to one of at least two open positions. In embodiments, the first actuator 16 is mounted in a recess 12*a* in the base 12 of the lid 10 and held in place by a cover 12*b* that extends around the base 12. In embodiments, the actuator 16 includes a button 16*a* accessible from an exterior of the lid 10. The cover 12*b* holds a button housing 16*b* in place in the recess 12*a*. In embodiments, the button housing 16*b* is provided in the recess 12*a* and the button 16*a* is mounted for movement in the housing 16*b*. In embodiments, the button 16*a* may be connected to a paddle 16*c* that is slidable laterally between three different positions to set a mode of the actuator 16. The button 16*a* may include a mode protrusion 16*a*1 that extends vertically upward. The button housing 16*b* may include three mode indentations 16*b*1, 16*b*2 and 16*b*3 of varying depths that interact with the mode protrusion 16*a*1 to limit movement of the button 16*a* inward, and thus limit movement of the paddle 16*c* and shaft 16*d*. In embodiments, the first indentation 16*b*1 is shallow such that the button 16*a* is prevented from moving inward when the mode protrusion 16*a*1 is aligned with the first indentation 16*b*1. The second indentation 16*b*2 is deeper than the first indentation 16*b*1 and allows for the button 16*a* to move inward a first distance when the mode protrusion 12*a*1 is aligned with the second indentation. The third indentation 16*b*3 is deeper than the second indentation 16*b*2 and allows the button 16*a* to move inward a second distance, larger than the first distance, when the mode protrusion 16*a*1 is aligned with the third indentation. In embodiments, the second distance is larger than the first distance such that the button 16*a*, and paddle 16*c* and shaft 16*d*, move inward further when the mode protrusion 16*a*1 is aligned with the third indentation 16*b*3.

In embodiments, the button paddle 16*c* may be operably connected to actuator shaft 16*d* that contacts the seal assembly 20. In embodiments, an end 16*d*1 of the shaft contacts the seal assembly 20. In embodiments, the end 16*d*1 may be angled to complement an angle of the arm on which the seal 20*a* is mounted. In embodiments, when the button 16*a* is pushed inward, the paddle 16*c* urges the shaft 16*d* in the same direction to move the seal element 20*a* away from the opening 30 as shown in FIG. 6B, for example. In embodiments, a biasing element 16*e* may be provided to bias the shaft 16*d*, paddle 16*c* and button 16*a* outward such that the seal element 20*a* remains seated in the opening 30 to seal the opening 30. In embodiments, a shaft seal 16*g* may be provided around the shaft 16*d* to prevent leakage of fluid out through the actuator 16. As noted above, the movement of the button 16*a* is limited by the interaction of the mode protrusion 16*a*1 with the first indentation 16*b*1, the second indentation 16*b*2 and the third indentation 16*b*3 of the button housing 16*b* such that the actuator 16 operates in at least three modes. In embodiments, additional mode protrusions may be used to provide for additional open positions.

In embodiments, when the mode protrusion 16*a*1 is aligned with the first indentation 16*b*1, as noted above, the shallow nature of the first indentation prevents inward movement of the button 16*a* as well as movement of the shaft 16*d* and the seal element 20*a* remains in the opening 30 in a closed mode or position. When the paddle 16*c* and button 16*a* slide laterally such that the mode protrusion 16*a*1 is aligned with the second indentation 16*b*2, when the user pushes the button 16*a* inward, the button moves inward the first distance, which, in turn, moves the shaft 16*d* the first distance and moves the seal element 20*a* a corresponding distance from the opening 30 to a first open position. In embodiments, this limited unsealing of the opening 30 may be suitable for use with a hot beverage to limit the amount of fluid that may exit via the opening 30. This may be considered a hot beverage mode where the amount of beverage that can pass is limited to reduce the risk of harm to the user in the event of a spill or exceptionally hot temperature.

In embodiments, when the button 16*a* slides laterally further such that the mode protrusion 16*a*1 is aligned with the third indentation 16*b*3, when the user pushes the button 16*a* inward, the button moves inward a second distance, which is larger than the first distance, which, in turn, moves the shaft 16*d* the second distance and moves the seal element 20*a* a further distance from the opening 30 to a second open position. In embodiments, this further distance allows more fluid to exit via the opening 30, which may be suitable, for example, for use with a cool beverage. In embodiments, the cover 12*b* may include indicia to indicate the lateral position of the button 16*a* and paddle 16*c*, and thus, the mode of the actuator 16. In embodiments, a mode window 12*c* may be provided in a top surface of the base 12. In embodiments, a mode selector 16*f* may be provided in the recess 12*a* and may move laterally with the button 16*a* and paddle 16*c* such that the mode of the actuator 16 is visibly indicated through the window 12*c*.

In embodiments, the sealing assembly 20 is mounted in a seal housing 20*d*. The seal housing 20*d* is removably mounted to the base 12 via the clip structure 20*e*. In embodiments, flexible paddles 20*e*1, 20*e*2 may extend outward through openings in the side of the housing 20*d* (see FIG. 2, for example) to hold the housing in place. In embodiments, the paddles 20*e*1, 20*e*2 may be pressed toward each other and inside the inner walls of the housing such that the housing 20*d*, and the sealing assembly 20, can be removed from the base 12. In embodiments, the housing 20*d* and the sealing assembly 20 may be removed for cleaning and then replaced. In embodiments, the housing 20*d* and sealing assembly 20 may be replaced if worn or dysfunctional.

In use, the button 16*a* may be placed in a locking mode such that the mode protrusion 16*a*1 is aligned with the first indentation 16*b*1 and the button 16*a* may be prevented from moving inward, such that the seal element 20*a* remains in the opening 30 to seal the opening. In embodiments, a user may move the button 16*a* laterally such that the mode protrusion 16*a*1 is aligned with the second indentation 16*b*2 in a hot beverage mode such that the button can be moved inward a first distance to move the seal element 20*a* away from the opening 30 to a first open position to allow for a limited amount of liquid to pass through the opening. In embodiments, the user may move the button 16*a* further laterally to a cold beverage mode such that the mode protrusion 16*a*1 is aligned with the third indentation 16*b*3 which allows the button to move a second distance inward to a second open position further away from the opening 30 to allow more liquid to flow through the opening.

Although the present invention has been described in relation to particular embodiments thereof, many other variations and modifications and other uses will become apparent to those skilled in the art. It is preferred, therefore, that the present invention be limited not by the specific disclosure herein.

What is claimed is:

1. A lid for a container comprising:

a base configured for connection to an open end of the container;

a drinking opening formed in a top surface of the base and in fluid communication with an interior of the container;

a sealing assembly movably mounted to move from a closed position in which the drinking opening is sealed, to a first open position in which the drinking opening is partially open and to a second open position in which the drinking opening is more open, wherein the seal assembly includes a seal housing removably mounted in the base and configured to be removably secured to the base using a clip structure that releasably engages openings in a wall of the seal housing;

a first actuator operably connected to the sealing assembly and movable relative to the lid to move the sealing assembly from the closed position to the first open position and to the second open position; and a button configured to interact with the first actuator to set a position of the sealing assembly.

2. The lid of claim 1, wherein the seal housing includes;

a seal arm movably attached to the seal housing and movable from the closed position to the first open position and the second open position;

a seal element mounted on the seal arm and configured to seal the drinking opening when the seal arm is in the closed position, to be spaced a first distance from the drinking opening when the seal arm is in the first open position and to be spaced a second distance from the drinking opening when the seal arm is in the second open position, wherein the second distance is larger than the first distance; and a biasing element configured to bias the seal element in the closed position.

3. The lid of claim 2, wherein the first actuator comprises:

a shaft operably connected to the sealing assembly and movable transverse to a central axis of the lid such that movement of the shaft inward moves the seal element away from the drinking opening;

a shaft seal surrounding the shaft and preventing leakage of liquid around the shaft;

a paddle operably connected to the shaft such that the paddle is movable with the shaft transverse to the central access and is also movable laterally;

a biasing element configured to bias the shaft outward such that the sealing assembly remains in the closed position; and the button accessible from an exterior of the lid and operably connected to the paddle such that pushing the button inward moves the paddle and shaft inward.

4. The lid of claim 3, further comprising a button housing mounted in the base, wherein the button is mounted in the button housing and connected to the paddle and movable laterally with the paddle, wherein movement of the button inward is prevented when the button and paddle are in a first lateral position, is limited when the button and paddle are in a second lateral position and is less limited when the button and paddle are in a third lateral position.

5. The lid of claim 4, wherein the button includes a mode protrusion extending upward therefrom and the button housing includes at least three indentations aligned with the mode protrusion and varying in depth to limit inward movement of the button and the paddle.

6. The lid of claim 5, wherein the first indentation is shallow to prevent inward movement of the button and paddle when the button and paddle are in the first lateral position such that the sealing assembly remains in the closed position.

7. The lid of claim 6, wherein a second indentation is deeper than the first indentation to allow inward movement of the button and paddle a first limited distance when the button and paddle are in the second lateral position such that the sealing assembly moves to the first open position.

8. The lid of claim 7, wherein a third indentation is deeper than the second indentation to allow inward movement of the button and paddle a second limited distance, which is larger than the first limited distance, when the button and paddle are in the third lateral position such that the sealing assembly moves to the second open position.

9. The lid of claim 4, wherein the first actuator includes an indicator operably connected to the paddle and movable therewith such that a position of the indicator is associated with a mode of operation of the lid.

10. The lid of claim 9, wherein the top surface of the base includes a window positioned to allow visual inspection of the indicator.

11. The lid of claim 4, further comprising a cover configured to hold the button housing in place in the base and including an opening to allow external access to the button.

12. The lid of claim 11, wherein the cover includes indicia positioned adjacent the opening and aligned with the button indicating a mode of operation associated with position of the button and the paddle.

13. The lid of claim 1, wherein the sealing assembly allows a first limited flow of liquid through the drinking opening in the first open position suitable for consumption of hot drinks to minimize risk of burning.

14. The lid of claim 13, wherein the sealing assembly allows a second limited flow of liquid larger than the first limited flow of liquid through the drinking opening in the second open position suitable for consumption of cool drinks.

* * * * *